US012372316B2

(12) United States Patent
Rainaud et al.

(10) Patent No.: US 12,372,316 B2
(45) Date of Patent: Jul. 29, 2025

(54) TAKEDOWN LEVER, TAKEDOWN SAFETY, AND TRIGGER SHOE

(71) Applicant: Sig Sauer, Inc., Newington, NH (US)

(72) Inventors: Tyler Rainaud, Nottingham, NH (US); Jacob Shawley, Somersworth, NH (US); Benjamin L. Froburg, Dover, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 18/673,514

(22) Filed: May 24, 2024

(65) Prior Publication Data

US 2024/0310133 A1 Sep. 19, 2024

Related U.S. Application Data

(63) Continuation of application No. 18/178,166, filed on Mar. 3, 2023, now Pat. No. 11,994,356, which is a continuation of application No. 17/696,054, filed on Mar. 16, 2022, now Pat. No. 11,624,570.

(51) Int. Cl.
*F41A 19/10* (2006.01)
*F41A 3/66* (2006.01)
*F41A 17/46* (2006.01)

(52) U.S. Cl.
CPC ..... *F41A 3/66* (2013.01); *F41A 17/46* (2013.01); *F41A 19/10* (2013.01)

(58) Field of Classification Search
CPC ..... F41A 19/10
USPC ..... 42/DIG. 1; 89/136
See application file for complete search history.

(56) References Cited

U.S. PATENT DOCUMENTS

| | | | | |
|---|---|---|---|---|
| 6,651,642 | B1 * | 11/2003 | Powers | F41B 5/1469 124/31 |
| D598,065 | S | 8/2009 | Vukovic et al. | |
| 7,992,338 | B2 * | 8/2011 | Bowman | F41A 19/10 42/90 |
| 8,371,058 | B2 | 2/2013 | Trpcic | |
| 9,021,730 | B2 | 5/2015 | Gentilini et al. | |
| 9,052,149 | B2 * | 6/2015 | Bender | F41A 19/10 |
| 9,303,936 | B2 | 4/2016 | Toner | |
| D755,324 | S | 5/2016 | Martelli et al. | |
| 9,441,897 | B2 | 9/2016 | Mather et al. | |

(Continued)

OTHER PUBLICATIONS

Sturm Ruger & Co., Ruger American Pistol Pro Owner Manual, Parts List and exploded view diagram, pp. 34-37 (2016).

*Primary Examiner* — Reginald S Tillman, Jr.
(74) *Attorney, Agent, or Firm* — Finch & Maloney PLLC

(57) ABSTRACT

A handgun trigger has a trigger body configured for pivotable or rotatable movement when installed in a handgun. A trigger shoe is removably attached or attachable to the trigger body and defines a user interface for firing the handgun. The trigger shoe can be made of polymeric material and can be attached to the trigger body using a snap fit. For example, the trigger shoe snaps over rear-facing surfaces of the trigger body when installed. Also disclosed is a takedown lever assembly for a semiautomatic handgun, where the takedown actuation lever operable between a firing position and a takedown position. In the takedown position the takedown actuation lever permits removal of the slide from the frame. In the takedown position the trigger is blocked from rotating to the pulled trigger position.

15 Claims, 10 Drawing Sheets

(56) References Cited

U.S. PATENT DOCUMENTS

| | | | | |
|---|---|---|---|---|
| D791,262 | S | 7/2017 | Brown et al. | |
| 9,546,831 | B2 | 7/2017 | Bandini et al. | |
| D832,388 | S | 10/2018 | McNally et al. | |
| 11,248,869 | B2 * | 2/2022 | Lopata | F41A 19/10 |
| 11,624,570 | B1 | 4/2023 | Rainaud et al. | |
| 11,994,356 | B2 | 5/2024 | Rainaud et al. | |
| 2016/0327357 | A1 * | 11/2016 | Wheatley | F41A 19/10 |
| 2023/0392886 | A1 | 12/2023 | Rainaud et al. | |

* cited by examiner

TAKEDOWN LEVER, TAKEDOWN SAFETY, AND TRIGGER SHOE

RELATED APPLICATIONS

This application claims priority under 35 U.S.C. § 120 as a continuation of U.S. application Ser. No. 18/178,166 filed on 3 Mar. 2023 (issued as U.S. Pat. No. 11,994,356 on May 28, 2024), which is a continuation of U.S. patent application Ser. No. 17/696,054 of the same title and filed on 16 Mar. 2022, the contents of which are incorporated herein by reference in its entirety.

FIELD OF THE DISCLOSURE

This disclosure relates to handgun components and more particularly to a takedown lever for a handgun, a takedown safety mechanism for a handgun, and a trigger shoe for a firearm trigger

BACKGROUND

Firearms design involves many non-trivial challenges. Traditionally, semiautomatic handguns have been made with a metal frame that includes the grip portion and a body portion with rails along a top surface. The grip portion defines a magazine well into which a magazine is installed. More recently, some semiautomatic handguns have a polymeric grip module that retains a metallic receiver in an open top of the grip module, where the receiver houses the fire control components and includes rails for the slide. Whether a metal frame or a polymeric grip module with drop-in receiver, a slide mounts to and can reciprocate longitudinally along rails that extend along the top of the frame or receiver. A takedown lever can be moved to a takedown position to remove the slide for cleaning and maintenance.

SUMMARY

One aspect of the present disclosure relates to a takedown lever that rotates counterclockwise from a firing position to a takedown position, as viewed looking at the left side of the handgun. This rotation direction is opposite that of existing takedown levers. Advantageously, the takedown lever can be used as a thumb rest when firing the handgun. Since the lever rotates counterclockwise rather than clockwise to the takedown position, the lever is stable for use as a rest with downward pressure applied by the user.

Another aspect of the present disclosure relates to a takedown lever assembly that includes a safety block. When the takedown lever is moved to the takedown position, the safety block moves rearwardly so that it protrudes into the magazine well. The safety block may additionally or alternately move against the trigger body to prevent the trigger from pivoting (i.e., from being pulled) when the takedown lever is in the takedown position.

A further aspect of the present disclosure relates to a trigger assembly that includes a trigger body and trigger shoe.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
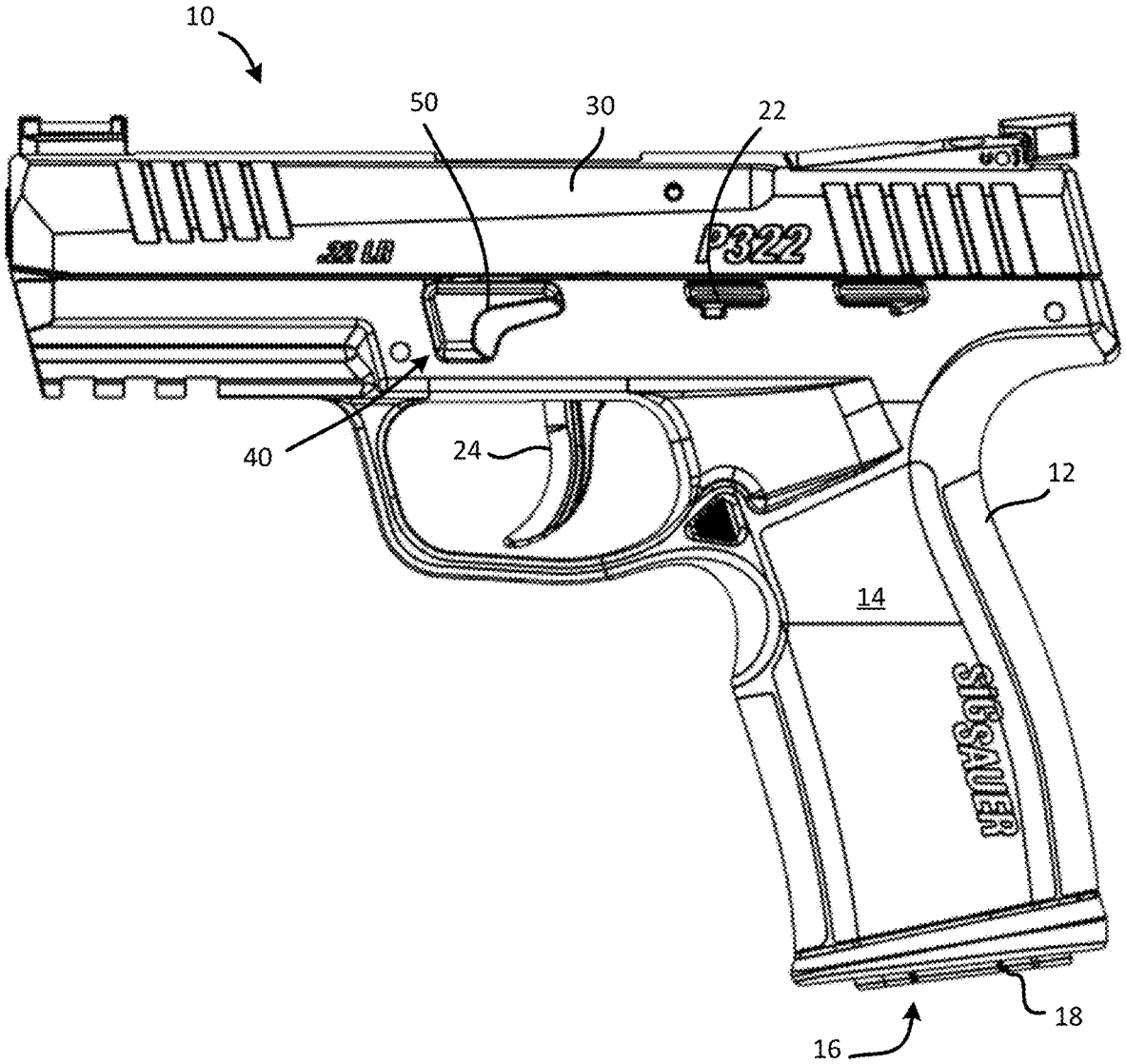
FIG. 1 illustrates a side view of a handgun with a takedown actuation lever, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

Disclosed is a takedown lever for a semiautomatic handgun. In accordance with one embodiment, the takedown lever rotates counterclockwise from the shooting position to the takedown position as viewed looking at the left side of the handgun. For example, in the takedown position, the lever wing extends upward along the slide from the lever shaft; in the shooting position, the lever extends horizontally and abuts the frame. Accordingly, when the lever is in the shooting position the user may use the takedown lever as a thumb rest. In some embodiments, the takedown lever can be shaped to enhance its use as a thumb rest.

Also disclosed is a takedown safety for a semiautomatic handgun. In one example, a block or lever is displaced rearwardly when the takedown lever is moved to the takedown position. When the mechanism includes a block, for example, a proximal end of the block protrudes into the magazine well and prevents installation of a magazine into the magazine well while the takedown lever is in the takedown position. Similarly, the takedown lever cannot be moved to the takedown position when a magazine is in the magazine well. This safety feature prevents the user from loading the gun while the takedown lever is in the takedown position, such as during cleaning.

In some embodiments, the lever or block abuts or is positioned closely adjacent to part of the trigger body when the takedown lever is in the takedown position. For example, a block moves to the front face of the trigger body above the trigger pin. Accordingly, the trigger cannot rotate and is blocked from being pulled by the user. One such embodiment is particularly useful in a hammer-fired handgun where blocking trigger rotation also prevents disengagement of the sear and therefore prevents release of the hammer. Accordingly, even if the gun contains a round in the chamber, the user cannot pull the trigger while the takedown lever is in the takedown position.

Further disclosed is a trigger assembly that includes a trigger body and a trigger shoe. In one example, the trigger shoe attaches to the trigger body using a snap fit. The removable trigger shoe enables the user to change the trigger shoe as desired for different profile, appearance, or material, and the user may do so without the need for armorer training.

General Overview

Safety continues to be an important challenge for firearms designers. Handguns can be made with external safety levers that are activated by the user. Handguns can also have one or more internal safeties that prevent discharge when the firearm is dropped, for example.

One non-trivial issue of firearms design and performance pertains to preventing unintended discharge during the takedown and cleaning process. When proper takedown protocol is followed, cleaning and servicing the firearm is a safe event. According to recognized safety protocol, the user first releases the magazine from the magazine well, followed by racking the slide to eject the chambered round (if present), and visually checking the chamber to ensure no ammunition is present. Finally, the user decocks the action or pulls the trigger full cycle to release the spring tension on the striker or hammer. From this condition, the user may proceed to disassemble or "take down" the handgun for cleaning or service Unfortunately, however, not all gun owners follow safe protocol and the result can be an unintentional discharge during the course of cleaning a handgun. For example, after releasing the magazine, the user may pull the trigger to decock the action without first clearing the chamber. If a round is chambered, pulling the trigger can fire the gun. Also, with the slide removed, some users may attempt to install a magazine into the magazine well, such as to view how the loaded magazine interacts with other components of the action. Again, an unsafe condition and unintentional discharge can result.

In the interest of preventing unintentional discharges when cleaning a handgun, a safety mechanism can prevent the user from unsafe actions when field stripping or cleaning the handgun. For example, one such safety prevents release of the hammer or striker when the slide is removed from the handgun. In another example, a safety prevents removing the slide when the magazine contains a magazine in the magazine well. Despite these advances, a need still exists for new safety mechanisms in handguns.

To address this need and others, the present disclosure relates to a safety mechanism for semiautomatic handguns. One aspect of the disclosure is directed to a takedown lever configured to rotate in a counterclockwise direction from the shooting position to the takedown position as viewed looking at the left side of the gun. Another aspect of the disclosure is directed to a takedown assembly for a hammer-fired handgun. In one example, the takedown lever engages and pivots a block having arms that extend rearwardly along sides of the trigger body. When the takedown lever is moved to the takedown position, the block is shifted rearwardly into contact with or closely adjacent to a front part of the trigger, blocking trigger rotation. At the same time, a proximal end portion of the arm or arms extends into the magazine well a distance sufficient to prevent a magazine from being installed in the magazine well. Similarly, the takedown lever is blocked by a magazine from moving to the takedown position if a magazine is present in the magazine well. The takedown assembly according to the present disclosure can prevent an unsafe condition during takedown by requiring the user to remove the magazine prior to moving the takedown actuation lever to the takedown position. The assembly also can block rotation of the trigger when the takedown actuation lever is in the takedown position. One additional aspect of the present disclosure relates to a trigger that includes a trigger body and a trigger shoe that can be removably attached to the trigger body, such as with a snap fit. Various aspects of the present disclosure can be utilized individually or in combination in a handgun. Numerous configurations and variations will be apparent in light of this disclosure.

As will be appreciated in light of this disclosure, and in accordance with some embodiments, a takedown assembly and its components can be used with a semiautomatic handgun, particularly one that is hammer-fired. In accordance with some example embodiments, a takedown assembly can be part of a semiautomatic handgun chambered in 0.22 LR, 0.380 Auto, 9 mm Luger, 0.357 SIG, 10 mm Auto, 0.40 S&W, 0.45 ACP ammunition, or any other suitable ammunition. As will further be appreciated, a removable trigger shoe in accordance with embodiments of the present disclosure can be used in handguns and long guns alike. Other suitable host firearms will be apparent in light of this disclosure.

As used herein, the term "frame" refers to the serialized component of a handgun that houses components of the fire control assembly. In metal handguns, for example, the frame may include the grip portion, trigger guard, and a portion of the frame that extends along the bottom of the barrel. In other handguns having a polymeric grip module, for example, the frame refers to the serialized metal component that can be secured into the open top portion of the grip module and along which the slide reciprocates.

While generally referred to herein as a takedown assembly for consistency and ease of understanding the present disclosure, the disclosed takedown assembly and its components are not limited to that specific terminology and alternatively can be referred to using other terms. For example, the takedown lever alternately can be referred to as a takedown actuation lever, a takedown tab, or other terms. In another example, the safety bar can alternately be referred to as a takedown safety lever, a takedown safety, a safety linkage, or other terms. As will be further appreciated, the particular configuration of a takedown assembly configured as described herein may be varied, for example, depending on whether the handgun is hammer-fired or striker-fired. Numerous configurations and embodiments will be apparent in light of this disclosure.

Takedown Lever Assembly

FIG. 1 illustrates a side view of the left side of a handgun 10 that includes a takedown lever assembly 40, in accordance with an embodiment of the present disclosure. The takedown lever assembly 40 includes a takedown actuation lever 50 that is shown in a first position or firing position. The handgun 10 includes a polymeric grip module 12 with a grip portion 14 that defines a magazine well 16 configured to receive a magazine 18. In this example, a magazine 18 is installed in the magazine well 16. A receiver 20 (not visible; shown in FIG. 2) is retained in a top of the grip module 12 and includes slide rails that engage the slide 30. Components of the fire control group are attached to or extend through the receiver 20, including the trigger 24, slide catch lever 22, and takedown actuation lever 50. A slide 30 is mounted on the top of the receiver 20 and can reciprocate longitudinally along the slide rails during use.

Figure 2:
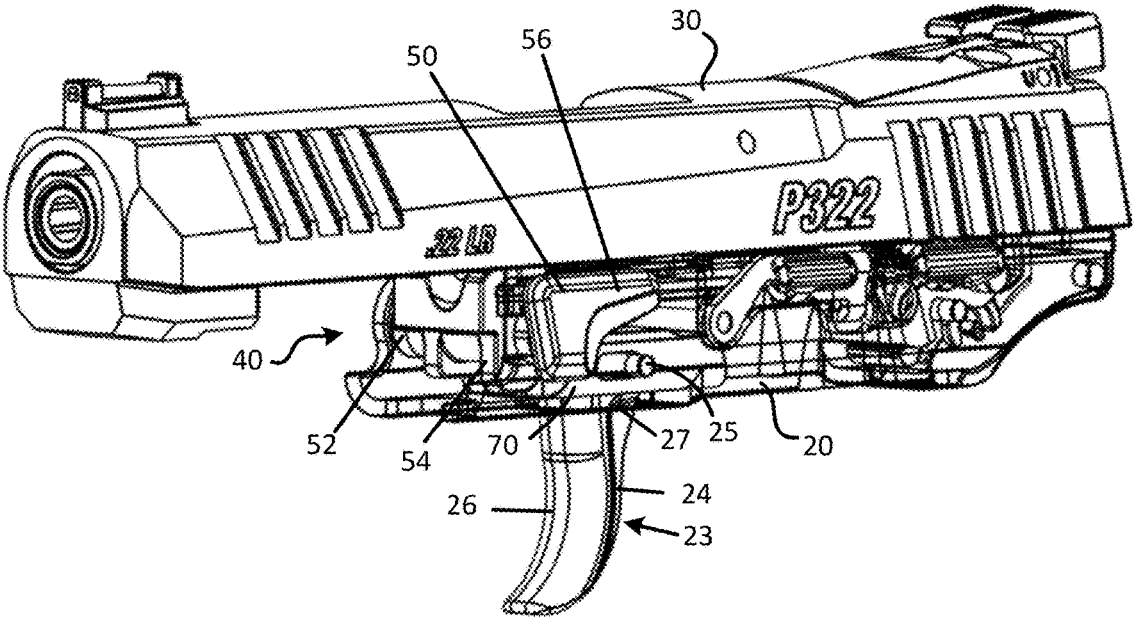
FIG. 2 illustrates a front perspective view of part of a handgun and shows components of a takedown lever assembly and trigger assembly, in accordance with an embodiment of the present disclosure.
Figure 3:
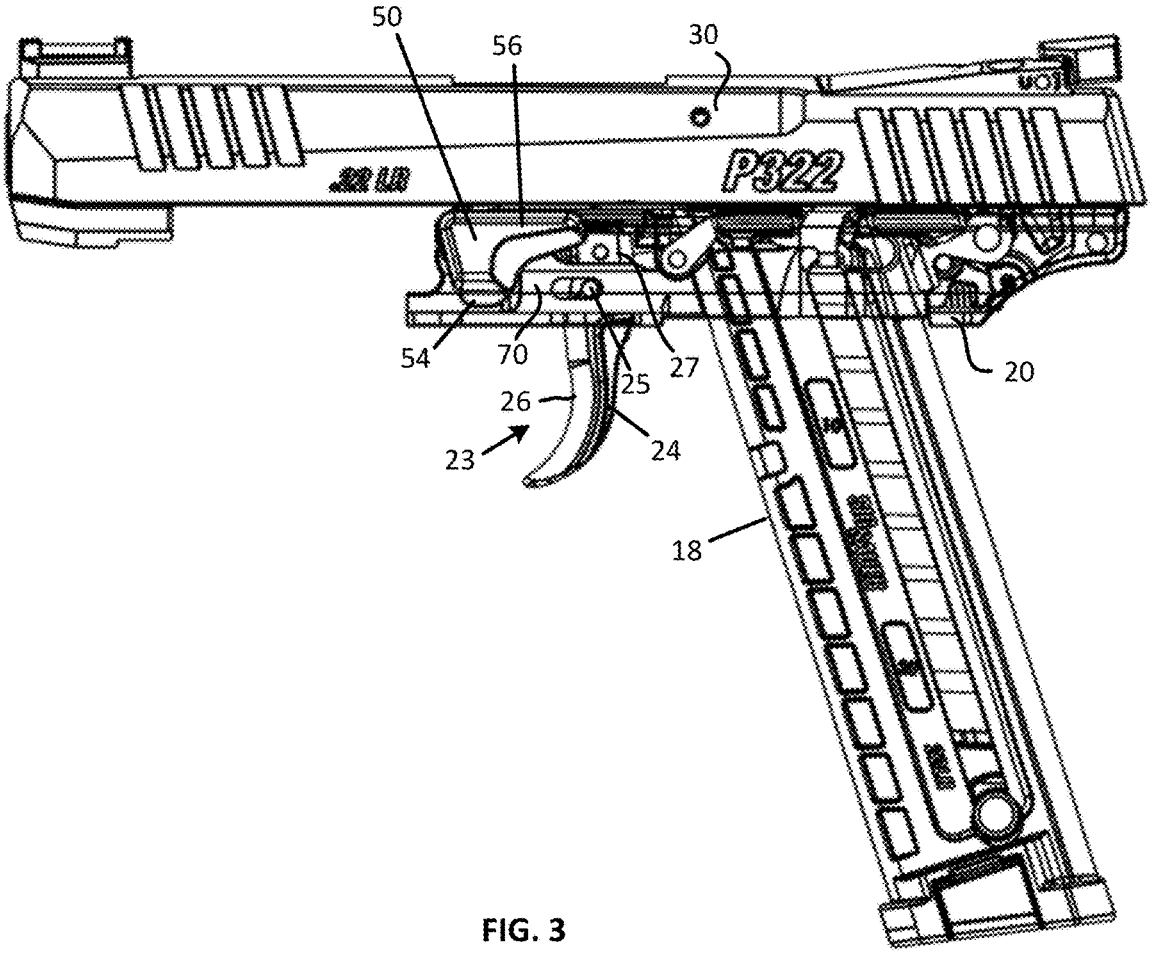
FIG. 3 illustrates a side view of the handgun of FIG. 1 with the grip module omitted to more clearly show components of the takedown lever assembly, in accordance with an embodiment of the present disclosure.

FIGS. 2 and 3 illustrates a front perspective view and a side view, respectively, showing a takedown lever assembly 40, a trigger assembly 23, and other components of the handgun 10 of FIG. 1. In this example, the grip module 12 is omitted to more clearly show the receiver 20 and components of the fire control group. In FIG. 3, a magazine 18 is installed.

The takedown lever assembly 40 includes the takedown actuation lever 50 and a safety block 70. The trigger assembly 23 includes the trigger 24, a trigger pin 25, and a trigger spring 28 (not visible; shown in FIGS. 4, 5, & 7). Other components are part of the handgun and function with the trigger assembly 23 and/or the takedown lever assembly 40, as will be appreciated.

As can be seen in FIG. 2, the takedown actuation lever 50 includes a lever shaft 52 that extends laterally through the receiver 20. The takedown actuation lever 50 includes a lever wing 56 on the outside of the receiver 20. The lever wing 56 is connected to the lever shaft 52 and extends along the outside of the receiver 20. A cam 54 extends radially outward from part of the lever shaft 52. The lever shaft 52, cam 54, and lever wing 56 typically are formed as a single monolithic component, but it is possible that these parts can be made as separate components and assembled. In this example, the takedown actuation lever 50 is in the firing position and the cam 54 extends radially outward from the lever shaft 52. The lever wing 56 functions as an interface or grip for the user to rotate the takedown actuation lever 50. In the firing position as shown, the top of the lever wing 56 extends horizontally along a bottom margin of the slide 30.

The trigger 24 can rotate between a resting position and a pulled position about a trigger pin 25 extending laterally through the trigger body 27 and safety block 70. A trigger shoe 26 attaches to a front, lower portion of the trigger body 27 and is positioned for manipulation by the user.

Figure 4:
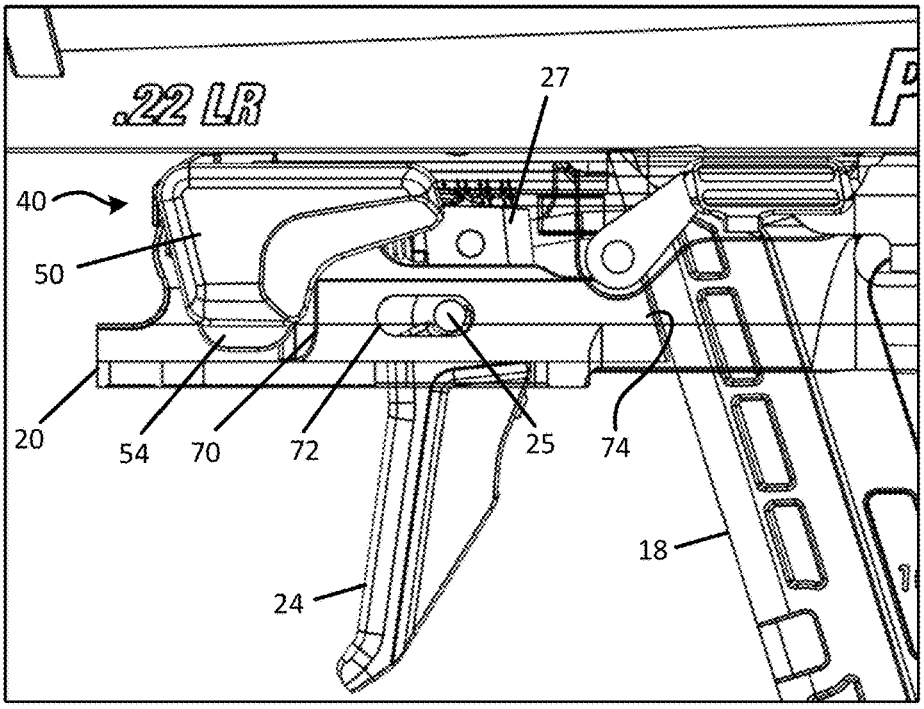
FIG. 4 illustrates a side view of part of a handgun and shows components of a takedown lever assembly and trigger assembly, in accordance with an embodiment of the present disclosure.

FIG. 4 shows a side view of part of the handgun with the receiver 20 shown transparent and the grip module omitted for clarity, in accordance with an embodiment of the present disclosure. In FIG. 4, the takedown lever assembly 40 can be seen, and includes the takedown actuation lever 50 and safety block 70. The takedown actuation lever 50 is in the firing position and the trigger 24 is in the resting position. The trigger body 27 extends upward between laterally spaced arms of a safety block 70, which is discussed in more detail below. The trigger pin 25 extends through the trigger body 27 and through an elongated pin opening 72 through the safety block 70. When the takedown actuation lever 50 is in the firing position, such as shown here, the trigger pin 25 occupies a proximal or rearward portion of the pin opening 72. Note also that the proximal end 74 of the safety block 70 does not interfere with the magazine 18, which is installed in the magazine well.

Figure 5:
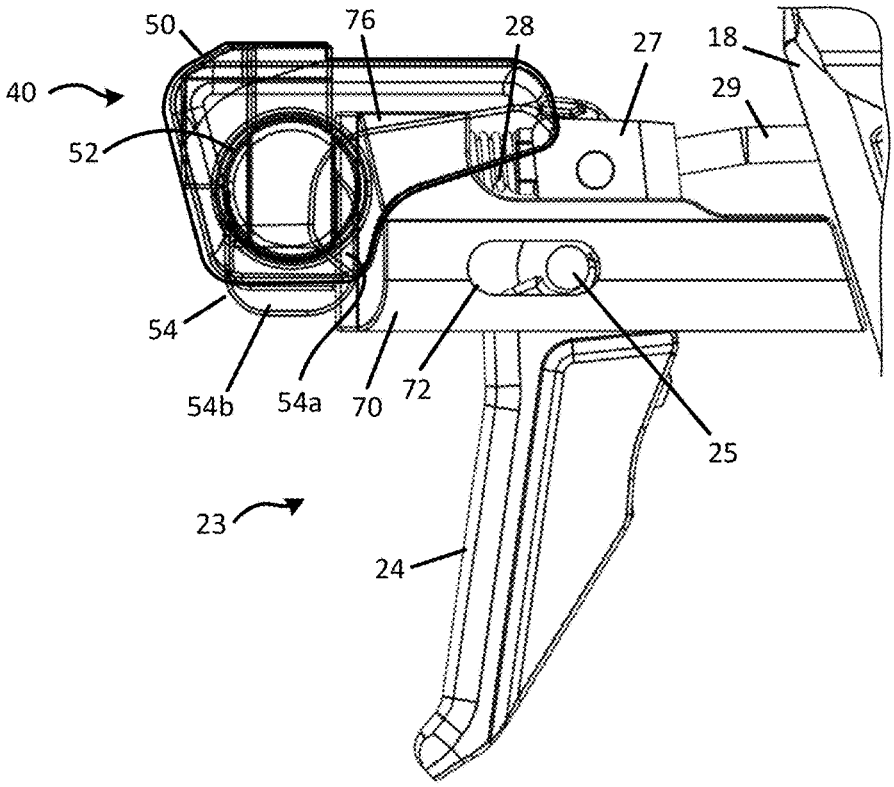
FIG. 5 illustrates a side view showing components of a takedown lever assembly, in accordance with an embodiment of the present disclosure.

FIG. 5 shows a side view of the takedown lever assembly 40, trigger assembly 23, and part of a magazine 18 with the takedown actuation lever 50 in the firing position and the trigger 24 in the resting position. The takedown actuation lever 50 is shown as transparent in this example. The trigger 24 is biased to the resting position by a trigger spring 28 between the safety block 70 and an upper end portion of the trigger body 27. At the same time, the trigger spring 28 biases the safety block 70 to the forward or non-blocking position. The trigger pin 25 occupies a proximal end portion of the elongated pin opening 72 that extends through the safety block 70. A trigger bar or sear lever 29 engages the trigger body 27 above the trigger pin 25. The upper portion 76 of the safety block 70 is spaced axially from the trigger body 27, which allows the trigger 24 to pivot if pulled. Pulling the trigger 24 would cause the trigger to rotate about the trigger pin 25 against the force of the trigger spring 28, in addition to other forces. Note that the trigger spring 28 and sear lever 29 generally have the same general vertical position with respect to the trigger 24.

The cam 54 has first and second portions that protrude radially away from the lever shaft 52. The first portion 54*a* of the cam 54, which has a first diameter, contacts a front of the safety block 70. The safety block 70 is firmly blocked by the cam 54 from moving forward and provides a solid stop for the trigger spring 28. The second portion 54*b* of the cam 54 has a second diameter that is greater than the first diameter.

Figure 6:
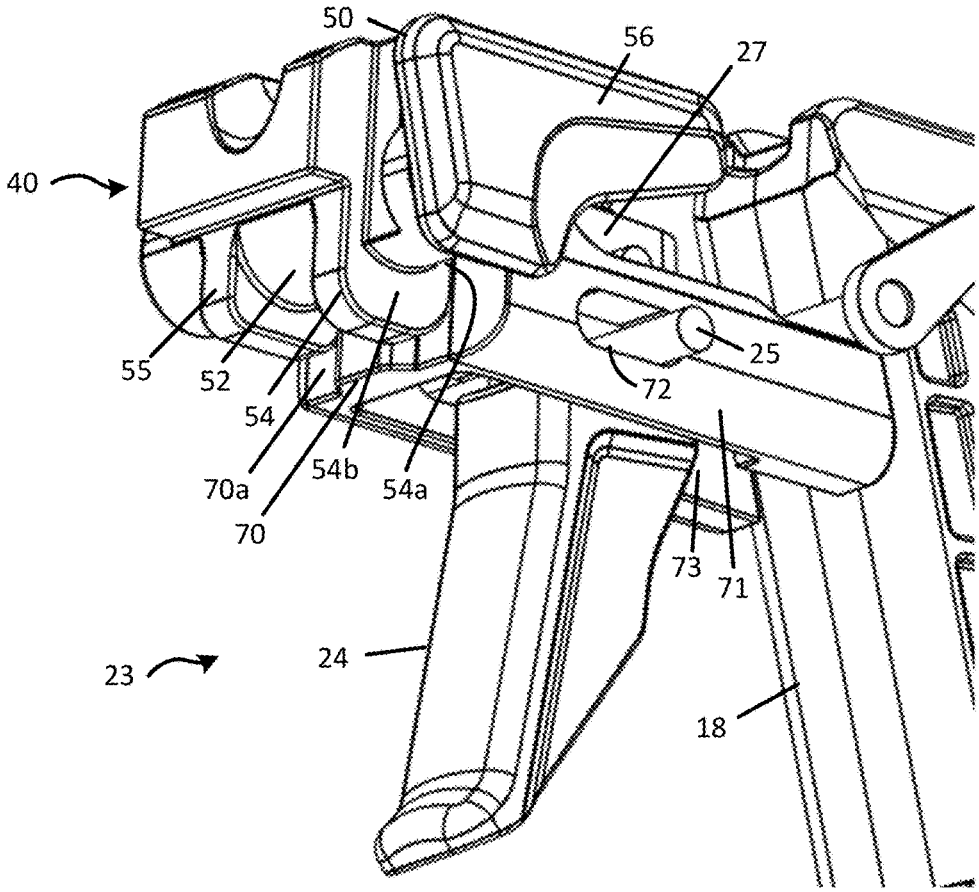
FIG. 6 illustrates a bottom and front perspective view showing components of a takedown lever assembly, in accordance with an embodiment of the present disclosure.

FIG. 6 illustrates a bottom, front, and side perspective view showing components of the takedown lever assembly 40 and trigger assembly 23, in accordance with an embodiment of the present disclosure. Here, the takedown actuation lever 50 is in the firing position and the trigger 24 is in the resting position. The trigger body 27 is positioned between a first arm 71 and a second arm 73 of the safety block 70. Note that a top of the lever wing 56 is generally oriented horizontally. The first portion 54*a* of the cam 54 extends rearward from the lever shaft 52 and abuts the front 70*a* of the safety block 70. The second portion 54*b* of the cam 54 extends downward from the lever shaft 52. The safety block 70 is in the forward or non-blocking position as evidenced by the trigger pin 25 occupying the rear of the elongated pin opening 72. A second cam 55 is spaced laterally from the cam 54 (or first cam 54) and also contacts the front 70*a* of the safety block 70. Note that the second cam 55 has a portion extending down from the lever shaft 52 that has a reduced radius compared to the second portion 54*b* of the first cam 54. This reduced radius permits assembly of the handgun components by providing clearance between the second cam 55 and the safety block 70 when the takedown actuation lever 50 is in the takedown position.

Figure 7:
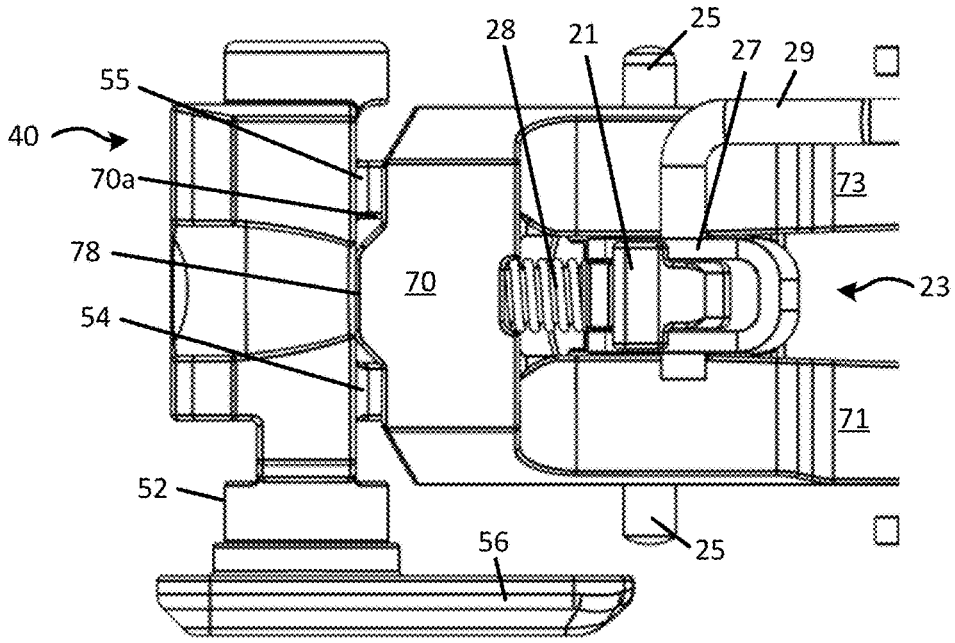
FIG. 7 illustrates a top view showing components of a takedown lever assembly, in accordance with an embodiment of the present disclosure.

FIG. 7 illustrates a top view showing components of the takedown lever assembly 40 and trigger assembly 23 with the takedown actuation lever 50 in the firing position and the trigger 24 at rest, in accordance with an embodiment of the present disclosure. The lever wing 56 extends rearwardly along the safety block 70. The first cam 54 and second cam 55 extend rearward from the lever shaft 52 and contact the front of the safety block 70. The first cam 54 is generally aligned with the first arm 71 and the second cam 55 is generally aligned with the second arm 73. The front 70*a* of the safety block 70 includes a protrusion 78 that extends forward and contacts the lever shaft 52 between the first and second cams 54, 55. This optional protrusion 78 provides an additional point of contact between the safety block 70 and the takedown actuation lever 50, which is retained in the receiver 20 (shown in FIGS. 2-4) at the rounded ends of the lever shaft 52. The trigger pin 25 extends between the trigger body 27 and a forward portion of the safety block 70. A trigger spring guide 21 permits the proximal end of the trigger spring 28 to pivot against the trigger body 27 and reduce buckling when the trigger is rotated about the trigger pin 25. The takedown actuation lever 50 overcomes the force of the trigger spring 28, shifting the safety block 70 rearward, in order to rotate to the takedown position. The trigger body 27 is positioned laterally between the first arm 71 and second arm 73 of the safety block 70. The trigger pin 25 extends laterally through the trigger 24 and the safety block 70. In the assembled state, ends of the trigger pin 25 engage sidewalls of the receiver 20. The sear lever 29 engages the trigger body 27 and extends rearwardly to the sear (not shown).

Figure 8:
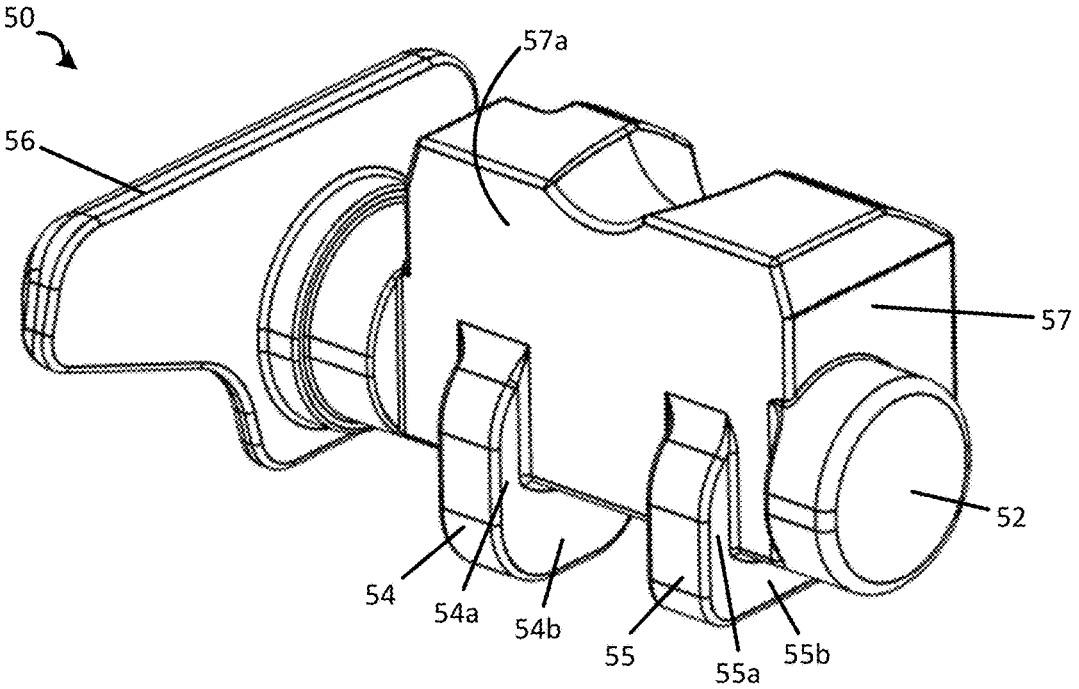
FIG. 8 illustrates a rear perspective view of a takedown actuation lever, in accordance with an embodiment of the present disclosure.

FIG. 8 illustrates a rear perspective view of the takedown actuation lever 50, in accordance with an embodiment of the present disclosure. The lever wing 56 connects to and extends rearward from an end of the lever shaft 52. The first cam 54 and second cam 55 extend radially outward from the lever shaft 52. As noted above, the first cam 54 includes a first portion 54*a* of a first radius and second portion 54*b* of a second radius. The second cam 55 includes a first portion 55*a* of a third radius substantially equal to the first radius of the first portion 54*a* of the first cam 54. The second cam 55 includes a second portion 55*b* of a fourth radius that is less than the second radius of the second portion 54*b* of the first cam 54. The fourth radius can be selected to provide clearance between the second cam 55 and the safety block 70 for installation and removal of the takedown actuation lever 50. The takedown actuation lever 50 also includes a lever body 57 that extends away from the lever shaft 52. In this example, the lever body 57 has a block shape or cuboid geometry with a rear face 57*a*. In this example, the lever body 57 extends from the lever shaft 52 in an opposite direction of the second portion 54*b* of the first cam 54. In this example, the lever body 57 is also oriented generally orthogonal (e.g., vertical) to the lever wing 56 (e.g., horizontal). In the firing position, the rear face 57*a* of the lever body 57 abuts the receiver 20, defining a hard stop for the takedown actuation lever 50 that prevents further rotation. This hard stop enables the takedown actuation lever 50 to be used as a thumb rest in the firing position.

Figure 9:
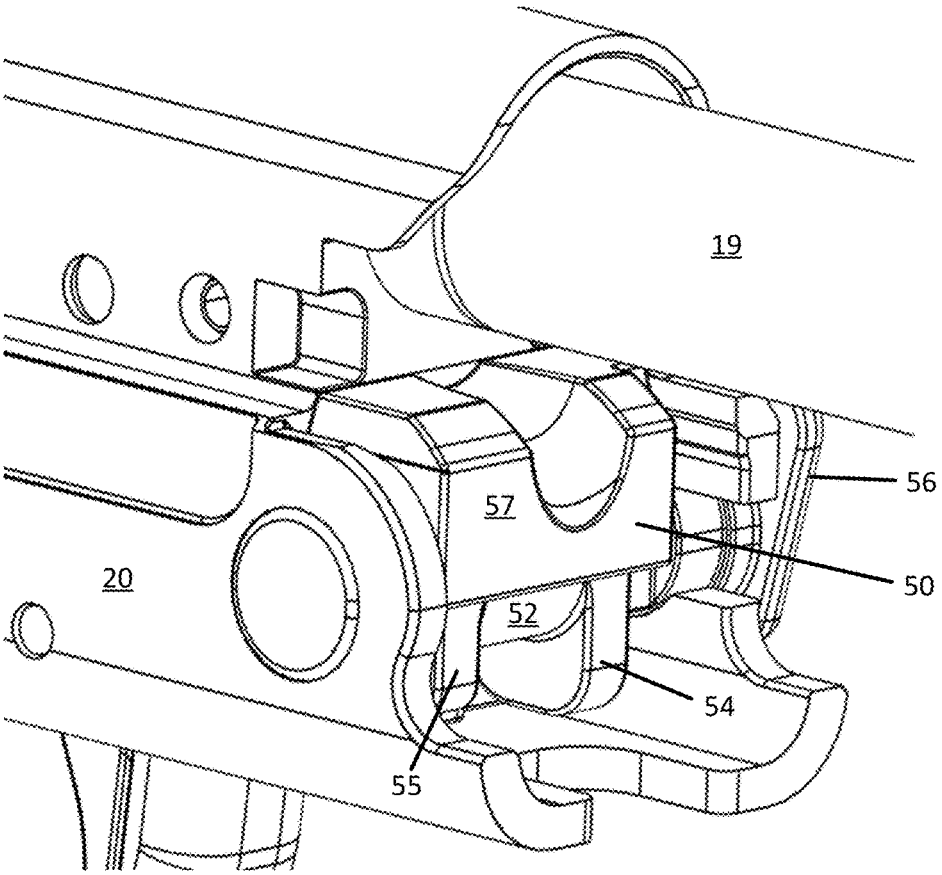
FIG. 9 illustrates a front perspective view showing a receiver with a barrel pinned in place, and a takedown actuation lever 50 in the firing position, in accordance with an embodiment of the present disclosure.

FIG. 9 illustrates a front perspective view showing the receiver 20 with a barrel 19 pinned in place, and with the takedown actuation lever 50 in the firing position. The rear face 57*a* (not visible; shown in FIG. 8) of the lever body 57 abuts the receiver 20, preventing rotation of the lever wing 56 downward (e.g., clockwise as viewed looking at the left side of the handgun). The first cam 54, second cam 55, and lever shaft 52 are also shown.

Figure 10:
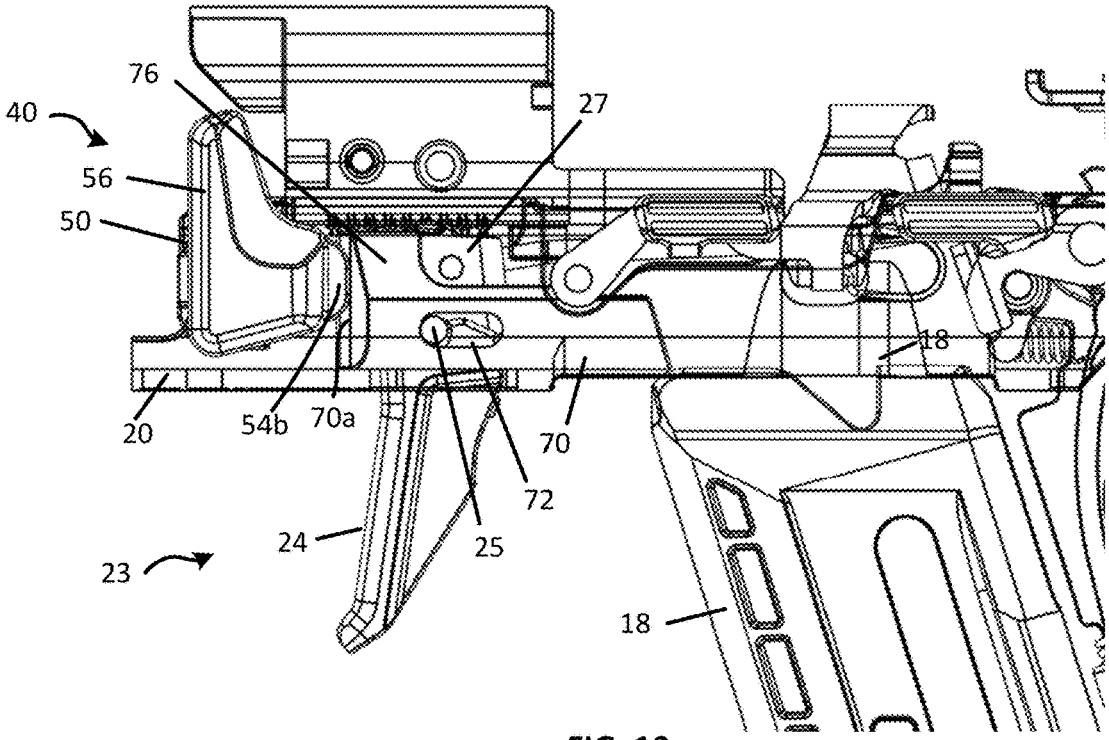
FIG. 10 illustrates a side view showing components of a takedown lever assembly with the takedown actuation lever in a takedown position, in accordance with an embodiment of the present disclosure.

FIG. 10 illustrates a side view showing components of the receiver 20, takedown lever assembly 40, and trigger assembly 23 with the takedown actuation lever 50 in the takedown position and the trigger 24 at rest, in accordance with an embodiment of the present disclosure. In the takedown position, the lever wing 56 extends upward and the second portion 54*b* of the cam contacts the front 70*a* of the safety block 70. Due to the increased radius of the second portion 54*b* of the cam 54, the safety block 70 is shifted rearwardly as evidenced by the trigger pin 25 occupying a forward portion of the elongated pin opening 72. Note also that the upper portion 76 of the safety block 70 abuts the trigger body 27. Further note that ends of the arms 71, 73 of the safety block 70 occupy the magazine well 16 and interfere with the magazine 18, which is shown in broken lines for reference. With the takedown actuation lever 50 in the takedown position, the trigger 24 is blocked from rotation (i.e., being pulled) due to the upper portion 76 of the safety block 70 abutting or nearly abutting the trigger body 27. A magazine 18 is also blocked from being installed in the magazine well 16, due to interference with the safety block 70.

Figure 11:
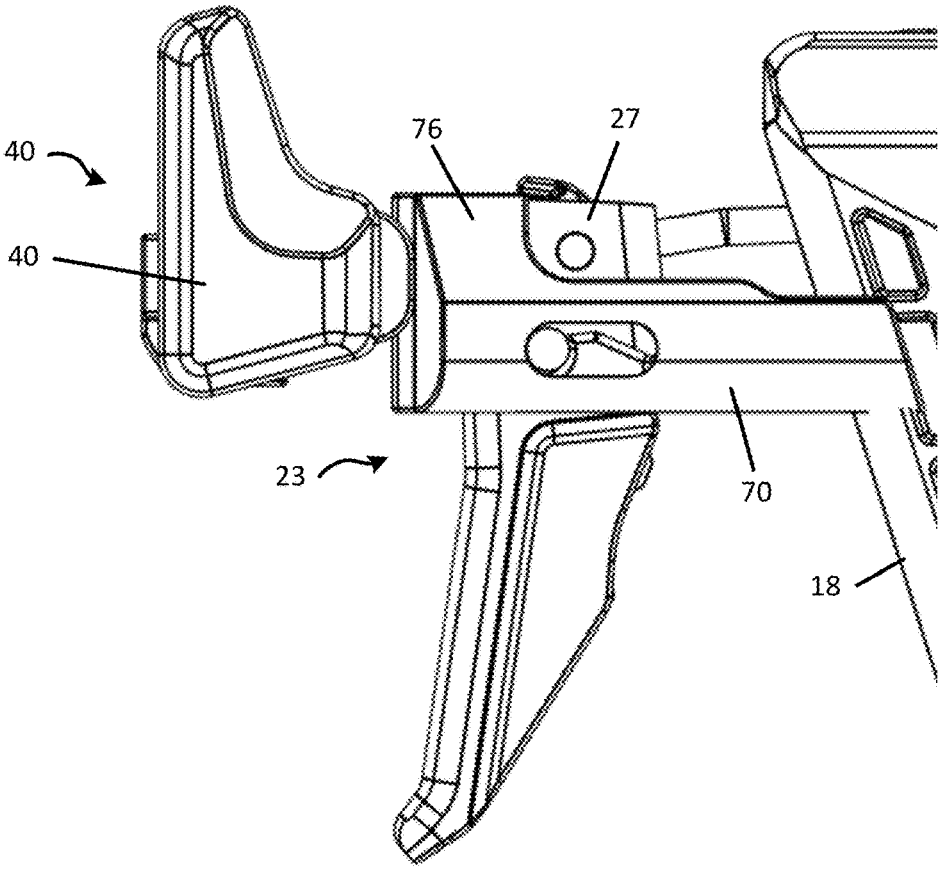
FIG. 11 illustrates a side view of components of a takedown lever assembly with the takedown actuation lever in a takedown position, in accordance with an embodiment of the present disclosure.

FIG. 11 illustrates a side view showing components of the takedown lever assembly 40, trigger assembly 23, and part of a magazine 18. Here, the takedown actuation lever 50 has been rotated counterclockwise to the takedown position with the lever wing 56 rotating upward and forward. In this position, the trigger 24 is at rest and is blocked by the upper portion 76 of the safety block 70 from rotating. The second portion 54*b* of the cam 54 abuts the front 70*a* of the safety block 70, causing the safety block 70 to move rearwardly into the magazine well 16 and the upper portion 76 of the safety block 70 to move against the trigger body 27. Part of a magazine 18 is shown for reference to show the interference between the safety block 70 and the magazine 18, but the magazine 18 would not be able to occupy the magazine well 16 with the takedown actuation lever 50 in the takedown position.

Figure 12:
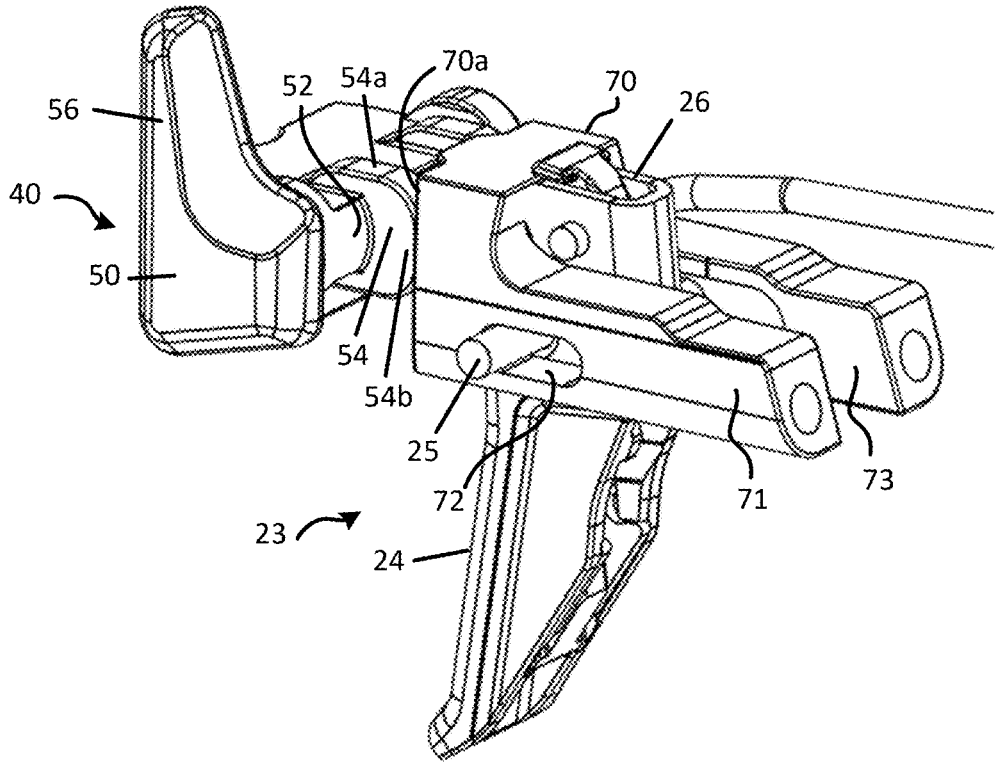
FIG. 12 illustrates a top and rear perspective view showing components of a takedown lever assembly with the takedown actuation lever in a takedown position, in accordance with an embodiment of the present disclosure.

FIG. 12 illustrates a top, side, and rear perspective view of the takedown lever assembly 40 and trigger assembly 23 with the takedown actuation lever 50 having been rotated counterclockwise about 90° to the takedown position, in accordance with an embodiment of the present disclosure. In this position, the lever wing 56 extends upward from the lever shaft 52. The second portion 54*b* of the cam 54 has pivoted with the lever wing 56 to contact the front 70*a* of the safety block 70. In doing so, the first portion 54*a* of the cam 54, which has a smaller radius, now faces upward and is not in contact with the safety block 70. The larger radius of the second portion 54*b*, and hence greater distance from the lever shaft 52 to the safety block, causes the safety block 70 to shift rearward so that the first arm 71 and second arm 73 extend into the magazine well 16 (shown, e.g., in FIG. 1) and the upper portion 76 of the safety lever is against the trigger body 27. In the rearward or blocking position of the safety block 70, the trigger pin 25 occupies a forward portion of the elongated pin opening 72. In this position, the safety block 70 interferes with installation of a magazine 18 and blocks the trigger 24 from pivoting.

Figure 13:
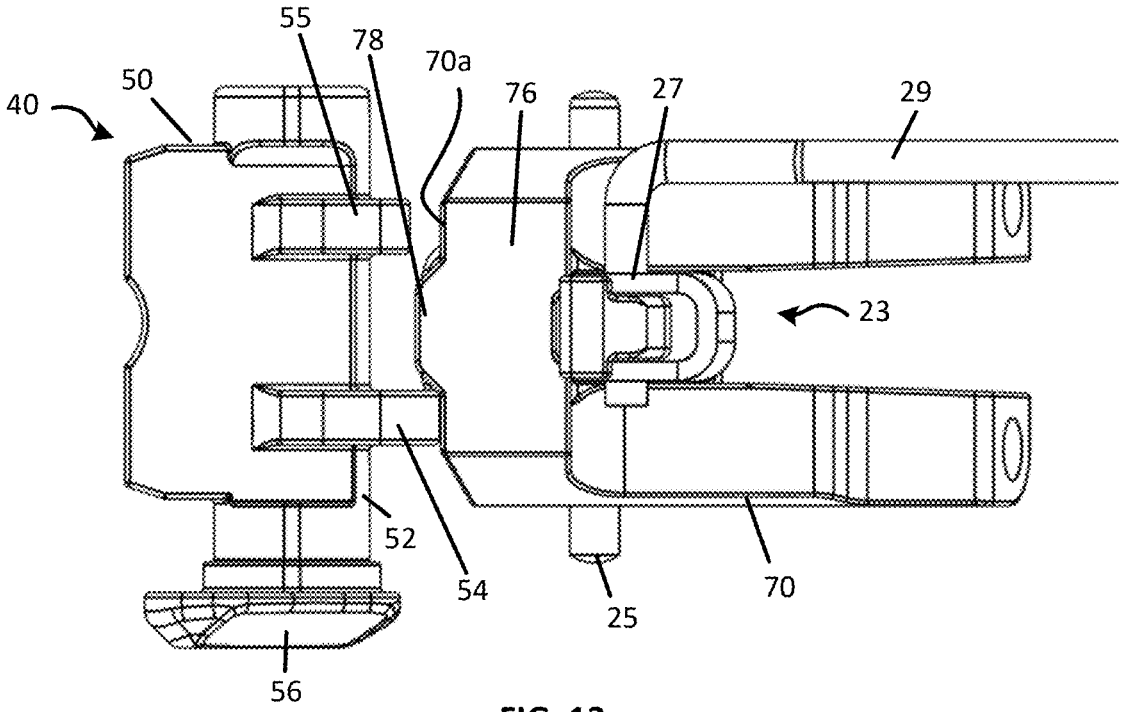
FIG. 13 illustrates a top view showing components of a takedown lever assembly with the takedown actuation lever in a takedown position, in accordance with an embodiment of the present disclosure.

FIG. 13 illustrates a top plan view of the takedown lever assembly 40 and trigger assembly 23 with the takedown actuation lever 50 in the takedown position as also shown in FIG. 12. The first cam 54 contacts the front 70*a* of the safety block 70 and the upper portion 76 of the safety block 70 abuts the trigger body 27. Thus, the safety block 70 blocks the trigger 24 from rotating about the trigger pin 25. Note that the second cam 55 is spaced axially from the safety block 70 and protrusion 78 is also spaced axially by the same amount from the lever shaft 52. In the event that the takedown actuation lever 50 is removed from the receiver 20, for example, it can be pulled laterally through the receiver 20 with the second cam 55 clearing the protrusion 78 on the safety block 70. Sear lever 29 and trigger spring guide 21 are also shown.

As discussed above with reference to FIGS. 1-13, a takedown actuation lever 50 can rotate counterclockwise from the firing position to the takedown position as viewed looking at the left side of the handgun. As such the lever wing 56 can be used as a thumb rest during use of the handgun without inadvertently rotating the lever to the takedown position.

The takedown actuation lever 50 can be part of a takedown lever assembly 40. When rotated to the takedown position, a cam 54 on the lever shaft 52 is configured to move a safety block 70 rearwardly. In doing so, part of the safety block 70 extends into the magazine well 16 to prevent the user from installing and seating a magazine into the gun. Similarly, when a magazine is present in the magazine well 16, the user cannot rotate the takedown actuation lever 50 to the takedown position due to the safety block contacting the magazine. Also, rotating the takedown actuation lever 50 to the takedown position moves the safety block 70 into contact with the trigger body 27, blocking the trigger 24 from rotating about the trigger pin 25. In the firing position, a body 57 of the takedown actuation lever 50 abuts the receiver 20, providing a hard stop that prevents further rotation of the takedown actuation lever 50 and enables the lever wing 56 to be used as a thumb rest when firing the handgun.

Embodiments of the takedown lever assembly 40 are discussed above in the context of a takedown actuation lever 50 that rotates counterclockwise about 90° from the firing position to the takedown position. For example, the lever wing rotates from a horizontal position where it extends rearward from the lever shaft to a generally vertical position where it extends upward from the lever shaft. It is contemplated within the scope of this disclosure that the takedown actuation lever 50 can rotate in the opposite direction. The takedown lever assembly 40 is also discussed above with reference to a safety block 70 that has a front portion extending laterally between and connecting arms 71, 73 that extending rearwardly along opposite sides of the trigger body 27. It is contemplated within the scope of the present disclosure that the safety block 70 could have the shape of a bar or lever, along with any necessary tabs or protrusions, as will be appreciated. Numerous variations and embodiment will be apparent in light of the present disclosure.

As will be appreciated in light of this disclosure, embodiments of takedown lever assembly 40 described herein are not limited to use with hammer-fired handguns and may be utilized with striker-fired handguns and other host firearms. In addition, embodiments of a trigger shoe, as variously disclosed herein, can be used with handguns and long guns, including pistols, rifles, and shotguns.

Components of takedown assembly may be constructed from any suitable materials as will be apparent in light of this disclosure. For example, some embodiments of takedown lever, safety block, and trigger shoe can be constructed from steel, polymers, composites, aluminum, or other materials. More generally, components of takedown assembly and trigger shoe can be constructed from any suitable material which is compliant, for example, with United States Defense Standard MIL-W-13855 (Weapons: Small Arms and Aircraft Armament Subsystems, General Specification For).

Trigger Shoe

Figure 14:
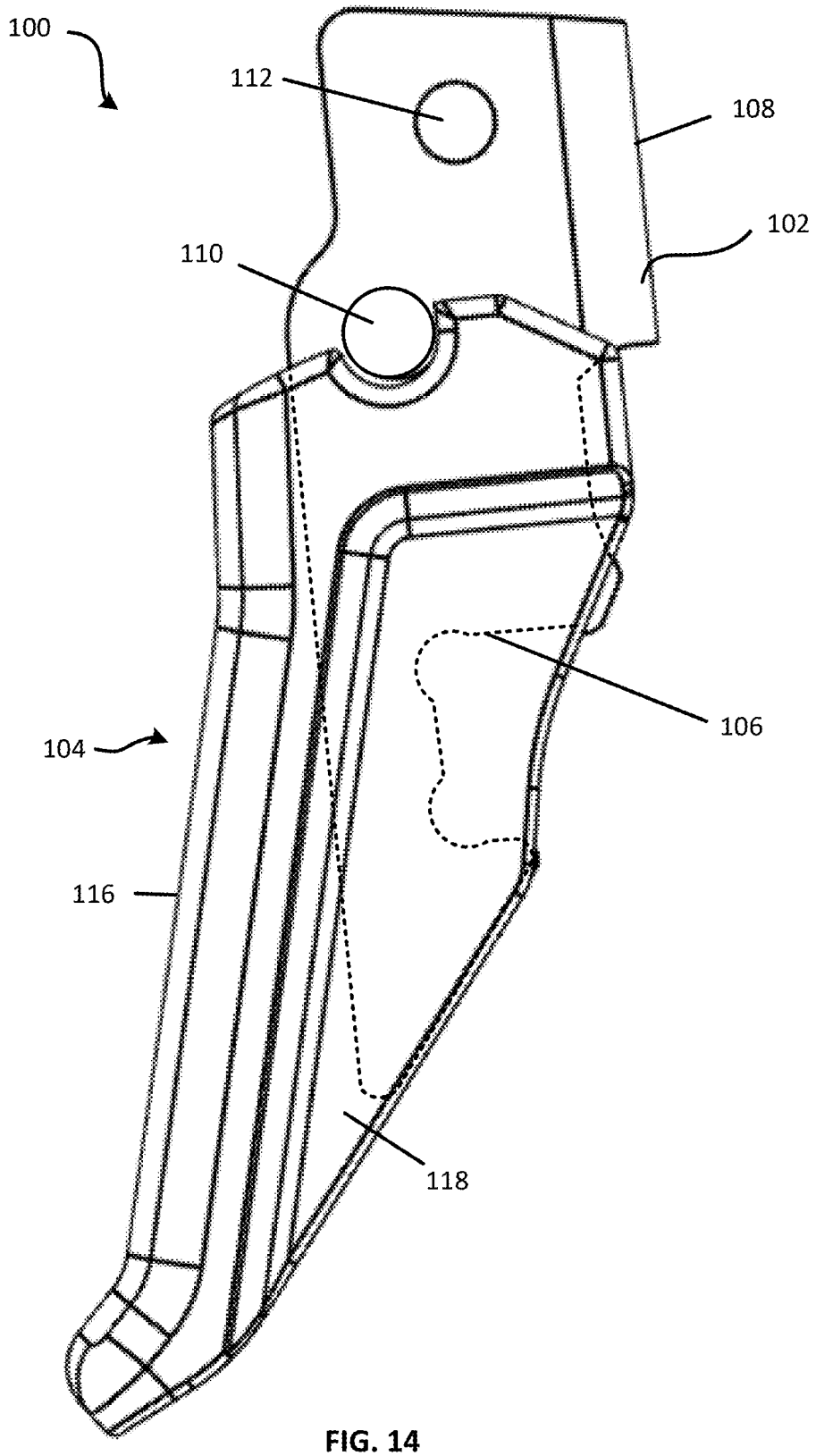
FIG. 14 illustrates a side view of a firearm trigger, in accordance with an embodiment of the present disclosure.

Referring now to FIG. 14, a side view illustrates a trigger assembly 100 that includes a trigger body 102 and a trigger shoe 104 that can be removably attached to the trigger body 102, in accordance with an embodiment of the present disclosure. The trigger body 102 includes a lower portion 106 (shown in broken lines) and an upper portion 108. The trigger body 102 defines a pin opening 110 sized to receive a trigger pin therethrough (e.g., trigger pin 25). The trigger body 102 can pivot about the trigger pin when manipulated by the user. The trigger body 102 may further define a trigger bar opening 112 for a trigger bar.

The trigger shoe 104 attaches removably over the lower portion 106 of the trigger body 102. The trigger shoe 104 can be installed over the front of the trigger body 102 and secured using a snap fit. For example, the trigger shoe 104 includes tabs that overlap a rear edge of the trigger body 102 when the trigger shoe 104 is installed. The trigger shoe 104 includes a user surface 116 and shoe side panels 118 extending rearward from the user surface 116. The user surface 116 can be flat or arcuate and is configured for the user to manipulate the trigger.

Figure 15A:
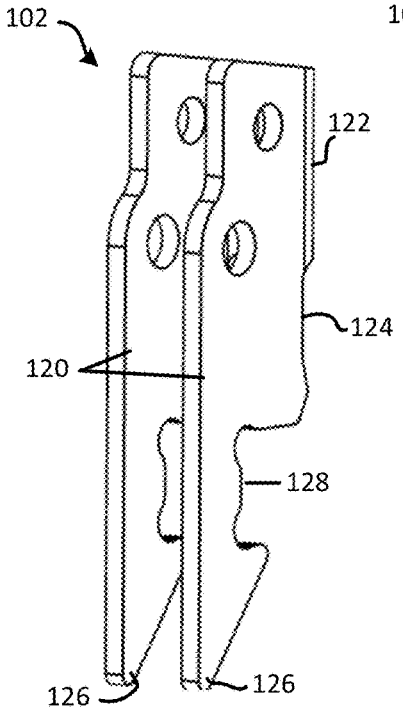
FIGS. 15A-15C illustrate a trigger body, in accordance with an embodiment of the present disclosure.
Figure 15B:
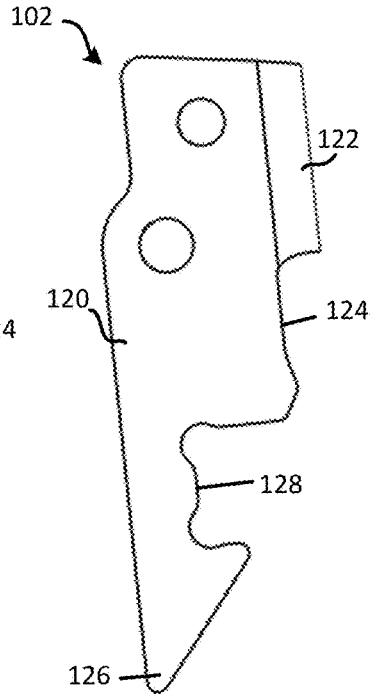
Figure 15C:
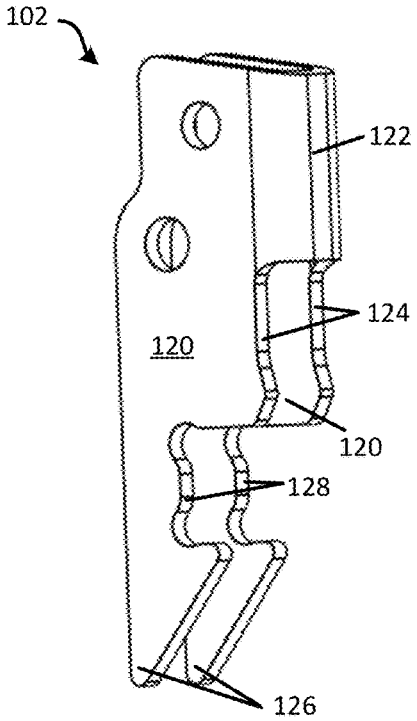

FIGS. 15A-15C illustrate a front perspective view, a side view, and a rear perspective view, respectively, of a trigger body 102, in accordance with one embodiment. The trigger body typically is made of metal, but it can also be made of rigid plastic (e.g., a reinforced polymer) or other suitable materials. The trigger body 102 includes a pair of sidewalls or side panels 120 having a generally upright orientation and positioned in a parallel, spaced-apart relationship. The side panels 120 are connected by rear portion 122 extending between the of each side panel 120. A lower end portion of each side panel 120 tapers to a point 126. In some embodiments, each side panel 120 defines a notch 128. The notch 128 can be used as an attachment point for catches 130 of the trigger shoe 104.

Figure 16A:
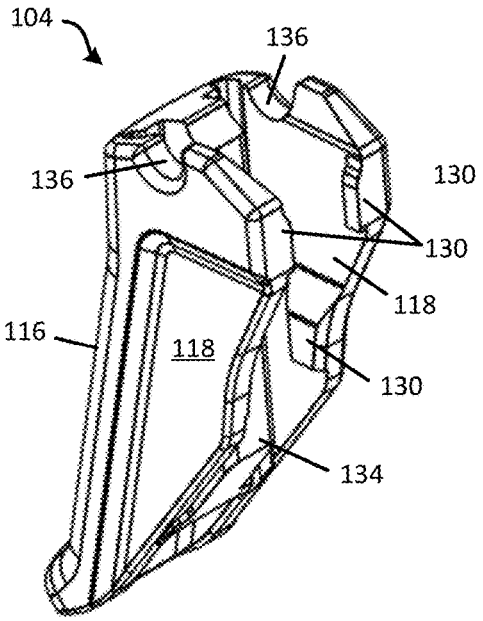
FIGS. 16A and 16B illustrate rear perspective views of a trigger shoe, in accordance with an embodiment of the present disclosure.
Figure 16B:
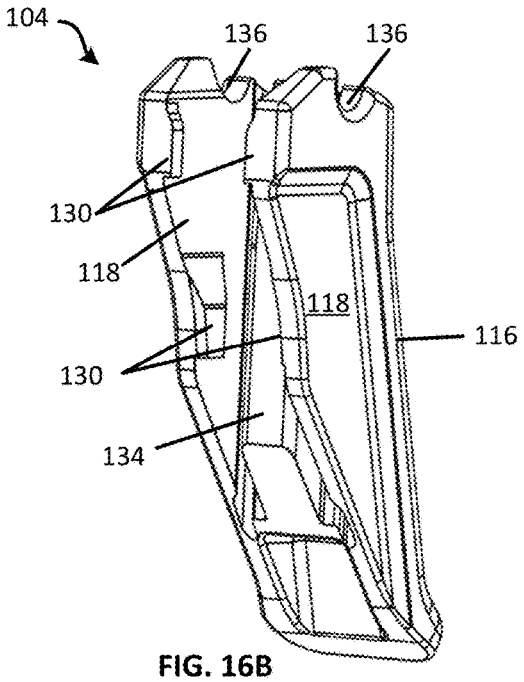

FIGS. 16A and 16B illustrate rear perspective views of a trigger shoe 104, in accordance with an embodiment of the present disclosure. In this example, the trigger shoe 104 includes a user surface 116 that is straight and generally planar along a majority portion. A side view of the trigger shoe 104 is also shown in FIG. 14. Shoe side portions 118 extend rearward from the user surface 116 in a spaced-apart, parallel relationship. One or both of the shoe side portions 118 includes one or more catch 130 that extends transversely (e.g., at 90°) From the rear of the shoe side portion 118 toward the opposite shoe side portion 118. Each catch 130 can be shaped as a lip, block, hook, or other shape that engages a corresponding portion of the rear face 124 of a side panel 120 of the trigger body 102. In some embodiments, the trigger shoe 104 includes a body 134 that extends rearward from a back side of the user surface 116 between the shoe side portions 118. The body 134 is sized and configured to be received between the side panels 120 of the trigger body 102. Optionally, a top of the trigger shoe 104 defines a recess 136 for the trigger pin. In combination, the recesses 136, body 134, and catches 130, the trigger shoe 104 can be seated and securely retained on the trigger body 102.

Figure 17A:
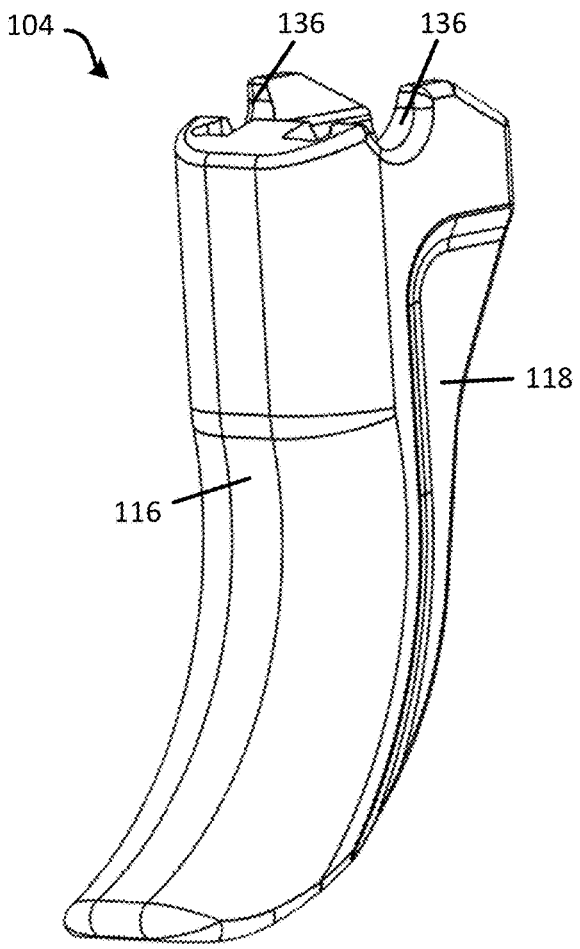
FIGS. 17A and 17B illustrate front and rear perspective views, respectively, of a trigger shoe, in accordance with another embodiment of the present disclosure.
Figure 17B:
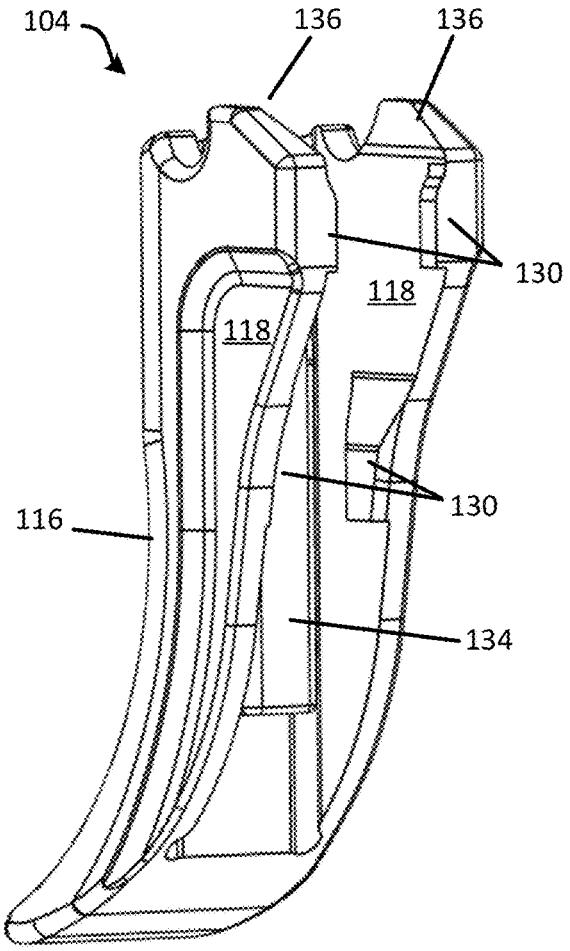

FIGS. 17A and 17B illustrate a trigger shoe 104 in accordance with another embodiment. In this example, the user surface 116 is curved along its length and laterally across the surface. Similar to the trigger shoe discussed above, this example includes catches 130, shoe side portions 118, body 134, and recesses 136.

To install the trigger shoe 104 on the trigger body 102, the shoe side panels 118 can be spread apart slightly to slide the catches 130 over the side panels 120 of the trigger body 102. After moving the trigger shoe 104 is moved rearward onto the trigger body 102 so that the catches 130 pass the rear face 124, the resilient force of the trigger shoe 104 returns the shoe side portions 118 to their previous shape with the catches overlapping the rear face 124 of the trigger body 102 (e.g., a snap fit).

FURTHER EXAMPLE EMBODIMENTS

The following examples pertain to embodiments of the present disclosure, from which numerous permutations and configurations will be apparent.

Example 1 is a takedown lever assembly for a semiautomatic handgun that includes a receiver, a slide displaceable along a top of the receiver, a grip portion defining a magazine well, and a fire control group that includes a scar operatively connected to a trigger. The takedown lever assembly comprises a takedown actuation lever operable between a firing position and a takedown position, where in the takedown position the takedown actuation lever permits removal of the slide from the frame; and a safety block operatively coupled to the takedown actuation lever, where moving the takedown actuation lever from the firing position to the takedown position moves the safety block rearward, thereby blocking the trigger from rotating to a pulled trigger position.

Example 2 includes the subject matter of Example 1, where the safety block moves into contact with the trigger in response to moving the takedown actuation lever to the takedown position.

Example 3 includes the subject matter of Example 1 or 2, where the safety block abuts an upper portion of the trigger when the takedown actuation lever is in the takedown position.

Example 4 includes the subject matter of any of Examples 1-3, where the takedown actuation lever includes a cam positioned to contact a front of the safety block during rotation of the takedown actuation lever.

Example 5 includes the subject matter of any of Examples 1-4, where the takedown actuation lever comprises a lever shaft extending crosswise through the receiver and a cam extending radially outward from the lever shaft, where the cam has a first cam portion with a first radius and a second cam portion with a second radius greater than the first radius. The first cam portion contacts a front of the safety block when the takedown actuation lever is in the firing position and the second cam portion contacts the front of the safety block when the takedown actuation lever is in the takedown position.

Example 6 includes the subject matter of Example 5, where the first cam portion is oriented on the lever shaft 90° from the second cam portion.

Example 7 includes the subject matter of any of Examples 1-6, where the safety block includes a distal portion extending crosswise to the receiver and at least one arm extending proximally from the distal portion along a side of the trigger. When the takedown actuation lever is in the takedown position, the distal portion abuts an upper portion of the trigger.

Example 8 includes the subject matter of Example 7, where the at least one arm includes a first arm and a second arm extending proximally from the distal portion in a spaced-apart, parallel relationship.

Example 9 includes the subject matter of Example 8, where the first arm extends along a left side of the trigger and the second arm extends along a right side of the trigger.

Example 10 includes the subject matter of any of Examples 1-9, where part of the safety block extends into the magazine well when the takedown actuation lever is in the takedown position.

Example 11 includes the subject matter of any of Examples 7-8, where a proximal end of the at least one arm extends into the magazine well when the takedown actuation lever is in the takedown position.

Example 12 includes the subject matter of any of Examples 1-11 and further comprises a sear operatively connected to the trigger.

Example 13 includes the subject matter of Example 12 and further comprises a hammer and a firing pin, the sear disengaging from the hammer upon pulling the trigger.

Example 14 includes the subject matter of any of Examples 1-6, where the safety block is configured as a lever extending rearward from the takedown actuation lever, the lever having a lateral protrusion positioned to obstruct trigger rotation when the takedown actuation lever is in the takedown position.

Example 15 includes the subject matter of Example 14, where a portion of the lever extends into the trigger well when the takedown actuation lever is in the takedown position.

Example 16 includes the subject matter of any of Examples 1-15, where the takedown actuation lever rotates counterclockwise from the shooting position to the takedown position as viewed looking at the left side of the handgun.

Example 17 includes the subject matter of any of Examples 1-16, where the trigger comprises a trigger body defining a pin opening, the trigger body rotatable about the pin opening between a resting position and a pulled position; and a trigger shoe removably attached to the trigger body via a snap fit.

Example 18 includes the subject matter of Example 17, where the trigger shoe fits over a front surface of the trigger body.

Example 19 includes the subject matter of Example 17 or 18, where the trigger shoe engages a rear surface of the trigger body when the trigger shoe is installed on the trigger body.

Example 20 includes the subject matter of any of Examples 1-19, where the takedown actuation lever includes a lever body extending from the lever shaft. When the takedown actuation lever is in the firing position, the lever body abuts (or is configured to abut) the receiver to prevent clockwise rotation of the takedown actuation lever as viewed looking at the left side of the handgun. Accordingly, the lever wing of the takedown actuation lever can be used as a thumb rest during use of the handgun.

Example 21 is a handgun comprising a grip portion defining a magazine well, a receiver defining a lever opening extending crosswise through the receiver, and a fire control group that includes a trigger rotatable between a resting position and a pulled trigger position; a takedown actuation lever comprising a lever shaft extending through the lever opening, a cam extending radially outward from the lever shaft, the cam including a first cam portion of a first radius and a second cam portion of a second radius that is greater than the first radius, and a lever wing connected to an end of the lever shaft and extending along a side of the receiver, where the takedown actuation lever is rotatable about the lever shaft between a firing position and a takedown position; and a safety block received in the receiver and disposed in contact with the cam; where rotating the takedown actuation lever to the takedown position moves the safety block rearward into abutment with an upper portion of the trigger.

Example 22 includes the subject matter of Example 21, where rotating the takedown actuation lever from the firing position to the takedown position is performed in a counterclockwise direction as viewed looking at a left side of the handgun.

Example 23 includes the subject matter of Example 22, where the first cam portion contacts a front of the safety block in the firing position and the second cam portion contacts the front of the safety block in the takedown position.

Example 24 includes the subject matter of any of Examples 21-23, where the safety block includes a distal portion extending crosswise to the receiver and also having at least one arm extending rearward from the distal portion along a side of the trigger. When the takedown actuation lever is in the takedown position, the distal portion abuts the trigger.

Example 25 includes the subject matter of Example 24, where the safety block includes a first arm and a second arm extending proximally from the distal portion in a spaced-apart, parallel relationship.

Example 26 includes the subject matter of Example 25, where the first arm extends along a left side of the trigger and the second arm extends along a right side of the trigger.

Example 27 includes the subject matter of any of Examples 21-26, where the part of the safety block extends into the magazine well when the takedown actuation lever is in the takedown position, thereby blocking a magazine from seating in the magazine well.

Example 28 includes the subject matter of any of Examples 21-27, where the takedown actuation lever includes a lever body extending from the lever shaft. When the takedown actuation lever is in the firing position, the lever body abuts the receiver to prevent clockwise rotation of the takedown actuation lever as viewed looking at the left side of the handgun. Accordingly, the lever wing of the takedown actuation lever can be used as a thumb rest during use of the handgun.

Example 29 is a handgun comprising a receiver extending along a bore axis, the receiver defining part of a magazine well and further defining a takedown lever opening extending laterally therethrough; a fire control assembly attached to the frame, the fire control assembly including a trigger rotatable about a trigger pin between a resting position and a pulled position, a hammer rotatable between a cocked position and a fire position, and a sear operable between a first position and a second position, where in the first position the sear is configured to engage and retain the hammer in the cocked position, and in the second position the sear disengages the hammer in response to the trigger moving to the fire position; a takedown actuation lever comprising a lever shaft extending through the takedown lever opening and a lever wing extending transversely from an end portion of the lever shaft, where the takedown actuation lever is rotatable about the lever shaft between a firing position and a takedown position, and a cam extending radially outward from the lever shaft; and a safety block operatively coupled to the takedown actuation lever via the cam, where the safety block moves proximally to a blocking position in response to rotating the takedown actuation lever from the firing position to the takedown position, where in the blocking position the safety block obstructs the trigger from rotating to the pulled position.

Example 30 includes the subject matter of Example 29, where the safety block abuts the trigger when the takedown actuation lever is in the takedown position.

Example 31 includes the subject matter of Example 30, where the safety block abuts part of the trigger above the trigger pin when the takedown actuation lever is in the takedown position Example 32 includes the subject matter of any of Examples 29-31, where the cam includes a first cam portion with a first radius and a second cam portion with a second radius greater than the first radius. The first cam portion contacts a front of the safety block when the takedown actuation lever is in the firing position and the second cam portion contacts the front of the safety block when the takedown actuation lever is in the takedown position.

Example 33 includes the subject matter of any of Examples 29-32, where the takedown actuation lever includes a lever body extending from the lever shaft. When the takedown actuation lever is in the firing position, the lever body abuts the receiver to prevent clockwise rotation of the takedown actuation lever as viewed looking at the left side of the handgun. Accordingly, the lever wing of the takedown actuation lever can be used as a thumb rest when firing the handgun.

Example 34 includes the subject matter of any of Examples 1-33 and further comprises a trigger reset spring between the trigger and the safety block.

Example 35 includes the subject matter of any of Examples 29-34, where the safety block includes a distal portion extending crosswise to the receiver and at least one arm connected to and extending proximally from the distal portion along a side of the trigger. When the takedown actuation lever is in the takedown position, the distal portion abuts the trigger.

Example 36 includes the subject matter of Example 35, where the at least one arm includes a first arm and a second arm extending proximally from the distal portion in a spaced-apart, parallel relationship, the first arm extending along a left side of the trigger and the second arm extending along a right side of the trigger.

Example 37 includes the subject matter of any of Examples 29-36, where part of the safety block occupies the magazine well when the takedown actuation lever is in the takedown position, thereby obstructing a magazine from seating in the magazine well.

Example 38 includes the subject matter of any of Examples 35-37, where a proximal end of the at least one arm extends into the magazine well when the takedown actuation lever is in the takedown position.

Example 39 includes the subject matter of any of Examples 29-34, where the safety block is configured as a bar extending rearward from the takedown actuation lever, the bar including a lateral protrusion configured and positioned to block trigger rotation when the takedown actuation lever is in the takedown position.

Example 40 includes the subject matter of Example 39, where part of the bar extends into the magazine well when the takedown actuation lever is in the takedown position.

Example 41 includes the subject matter of any of Examples 29-40, where the takedown actuation lever rotates counterclockwise from the firing position to the takedown position as viewed looking at a left side of the handgun. For example, the lever wing rotates upward and forward to the takedown position. In the firing position, the lever wing extends rearward along the bottom of the slide; in the takedown position, the lever wing extends from the lever shaft upward along the side of the slide.

Example 42 is a trigger comprising a trigger body defining a pin opening; and a trigger shoe removably attached to the trigger body via a snap fit.

Example 43 includes the subject matter of Example 42, where the trigger shoe fits over a front surface of the trigger body.

Example 44 includes the subject matter of Example 42 or 43, where the trigger shoe engages a rear surface of the trigger body when installed on the trigger body.

Example 45 includes the subject matter of any of Examples 42-44, where the trigger shoe comprises a polymer.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A trigger for a firearm, comprising:

a trigger body having a front wall and sidewalls that are spaced apart and extend rearward from the front wall to a rear-end surface; and a trigger shoe removably attached to the trigger body, the trigger shoe having a front surface defining a user interface for firing the firearm, and having spaced-apart sidewalls each having a catch surface;

wherein the trigger shoe is configured to be installed with a snap fit over the front wall of the trigger body such that the catch surface on the sidewalls of the trigger shoe engages the respective rear-end surface of each of the sidewalls of the trigger body.

2. The trigger of claim 1, wherein the trigger shoe covers the front and sidewalls of the trigger body in an installed state.

3. The trigger of claim 2, wherein each of the sidewalls of the trigger body defines a notch the rear margin that includes a part of the rear-end surface, and wherein when installed each catch surface engages the part of the rear-end surface in the notch.

4. The trigger of claim 1, wherein the trigger shoe is made of a polymeric material.

5. The trigger of claim 4, wherein the trigger body is made of a reinforced polymeric material.

6. The trigger of claim 1, wherein the user interface has a linear profile as viewed from a side of the trigger shoe.

7. A firearm comprising the trigger of claim 1.

8. The firearm of claim 7, wherein the firearm is a semiautomatic handgun.

9. The firearm of claim 7, wherein the firearm is a rifle.

10. A trigger component for a firearm comprising:

a trigger shoe configured to be removably attached to a trigger body having a front wall and sidewalls that extend rearward from the front wall to a rear-end surface, the trigger shoe comprising:

a front surface defining a user interface for firing the firearm; and spaced-apart sidewalls each having a catch surface;

wherein the trigger shoe is configured to be installed with a snap fit over the front wall of the trigger body such that each catch surface engages the rear-end surface of a respective one of the sidewalls of the trigger body.

11. The trigger component of claim 10, wherein the trigger shoe is configured to cover the front wall and the sidewalls of the trigger body in an installed state.

12. The trigger component of claim 11, wherein each protrusion is configured as a lateral protrusion.

13. A method comprising:

providing a firearm having a trigger body with a front wall and sidewalls that are spaced apart and extend rearward from the front wall to a rear-end surface;

providing a trigger shoe configured to be removably installed on the trigger body, the trigger shoe having a front surface defining a user interface for firing the firearm, and having spaced-apart sidewalls each having a catch surface; and installing the trigger shoe over the front wall of the trigger body using a snap fit so that the trigger shoe extends over the front wall and sidewalls of the trigger body, and so that the catch surface engages the respective rear-end surface of the sidewalls of the trigger body.

14. The method of claim 13, wherein installing the trigger shoe includes pressing the trigger shoe rearwardly onto the trigger body so that the trigger shoe snaps over a rear surface of the trigger body.

15. The method of claim 14, wherein the trigger shoe is a first trigger shoe, wherein providing the firearm includes providing a second trigger shoe installed on the trigger body, wherein a profile of the first trigger shoe differs from a profile of the second trigger shoe, and wherein the method further comprises removing the second trigger shoe from the trigger body prior to installing the first trigger shoe.

* * * * *